US008833210B2

(12) United States Patent
Huang

(10) Patent No.: US 8,833,210 B2
(45) Date of Patent: Sep. 16, 2014

(54) HAND TOOL HAVING A PRESSING SPRING

(71) Applicant: Hsin-Hsien Huang, Taichung (TW)

(72) Inventor: Hsin-Hsien Huang, Taichung (TW)

( * ) Notice: Subject to any disclaimer, the term of this patent is extended or adjusted under 35 U.S.C. 154(b) by 204 days.

(21) Appl. No.: 13/633,896

(22) Filed: Oct. 3, 2012

(65) Prior Publication Data

US 2014/0090522 A1 Apr. 3, 2014

(51) Int. Cl.
*B25B 23/16* (2006.01)

(52) U.S. Cl.
USPC ..... 81/177.8

(58) Field of Classification Search
USPC ..... 81/177.5–177.7, 177.8, 177.9
See application file for complete search history.

(56) References Cited

U.S. PATENT DOCUMENTS 7,287,450 B1 10/2007 Liao

*Primary Examiner* — David B Thomas
(74) *Attorney, Agent, or Firm* — Cheng-Ju Chiang

(57) ABSTRACT

The present invention relates to a hand tool having a pressing spring. The hand tool comprises a grip part and a tool part. The tool part comprises a tool rod, a tool rod pivot head, a pair of external fixing pieces and a pressing spring. The pair of external fixing pieces is pivotally connected to the tool rod pivot head. When the tool rod is rotated, a relationship between the tool rod and the pair of external fixing pieces is switchable to one of a collinear relationship or a vertical relationship thereof, and the tool rod is pressed by the pressing spring without being loose after switching. Accordingly, the present invention has advantages and effects of directly switching, firm and stable positioning and not easy to be loose, and so on.

2 Claims, 6 Drawing Sheets

HAND TOOL HAVING A PRESSING SPRING

BACKGROUND OF THE INVENTION

1. Field of the Invention

The present invention relates to a hand tool having a pressing spring, and in particular to a hand tool having a pressing spring with strong pressing forces, and having advantages and effects of directly switching, firm and stable positioning and not easy to be loose, and so on.

2. The Related Arts

Traditional switchable hand tools comprise a design of a switching button, and the traditional switchable hand tools release their fixing status by pressing the switching button in order to switch between their vertical relationship and linear relationship.

However, the design of traditional switchable hand tools generally has the following two shortcomings:

1. Inconvenient to operate. Traditional switchable hand tools are able to release their fixing status only when the switching button is pressed in process of switching between their vertical relationship and linear relationship, and it is apparently rather inconvenient to operate;

2. Ineffective/defective positioning. Traditional switchable hand tools use their switching button to realize switching and releasing of their fixing status. Such design is usually difficult to achieve strong fixing purposes and results in problems during use, such as slack positioning and easily loosing, and so on.

Therefore, there is a need to develop new products in order to solve the above-mentioned disadvantages and problems.

SUMMARY OF THE INVENTION

An objective of the present invention is to provide a hand tool having a pressing spring. The hand tool has advantages and effects of directly switching, firm and stable positioning and not easy to be loose, and so on. The present invention is able to solve the problems of operational inconvenience and ineffective/defective positioning of prior arts.

To solve the above problems, the present invention provides a hand tool having a pressing spring. The hand tool comprises a grip part comprising an interior passageway, a guide groove, a passageway opening, a wall opening and a pair of flexible stopper parts. The interior passageway comprises two ends, one end thereof is defined as the passage opening and the other end is defined as a closed end. The guide groove communicates with the interior passageway, and extends parallel to the interior passageway along an axial direction of the interior passageway. The pair of flexible stopper parts is deformable and restorable after deformation.

The hand tool further comprises a tool part. The tool part is partially disposed in the interior passageway of the grip part, and comprises a tool rod, a tool rod pivot head, a pair of external fixing pieces, a pressing spring, a pivot shaft and a fixing element.

One end of the tool rod comprises a work part, and the other end thereof is set as the tool rod pivot head.

The tool rod pivot head comprises a first pressing surface, a second pressing surface and a bump.

Each of the external fixing pieces comprises a first end part and a second end part. The first end part of the each external fixing piece comprises a first hole, and the second end part of the each external fixing piece comprises a second hole.

The pressing spring comprises a fixing hole, a spring part, and a protruding guide part. The protruding guide part is engaged and snapped in the guide groove. The pivot shaft is disposed to pass through the tool rod pivot head and the first holes of the pair of the external fixing piece so that the external fixing piece is pivotally connected to the tool rod pivot head. The fixing element is used to pass through the second holes of the pair of external fixing pieces and the fixing hole of the pressing spring, and is fixed therein so as to integrally fix the pair of external fixing pieces and the pressing spring together.

Accordingly, the tool rod and the pair of external fixing pieces are capable of being switched between a collinear relationship and a vertical relationship thereof. When in the linear relationship, the pressing spring presses on the first pressing surface of the tool rod pivot head to maintain the collinear relationship between the tool rod and the pair of external fixing pieces without being loose. On the contrary, when in the vertical relationship, the pressing spring presses on the second pressing surface of the tool rod pivot head to maintain the vertical relationship between the tool rod and the pair of external fixing pieces without being loose.

The purposes and advantages of the present invention as described above are not difficult to understand in depth from detailed descriptions and drawings of the following selected embodiments.

The embodiments of the present invention are hereby given by detailed descriptions in cooperation with drawings as follows.

DETAILED DESCRIPTION OF PREFERRED EMBODIMENT

Figure 1:
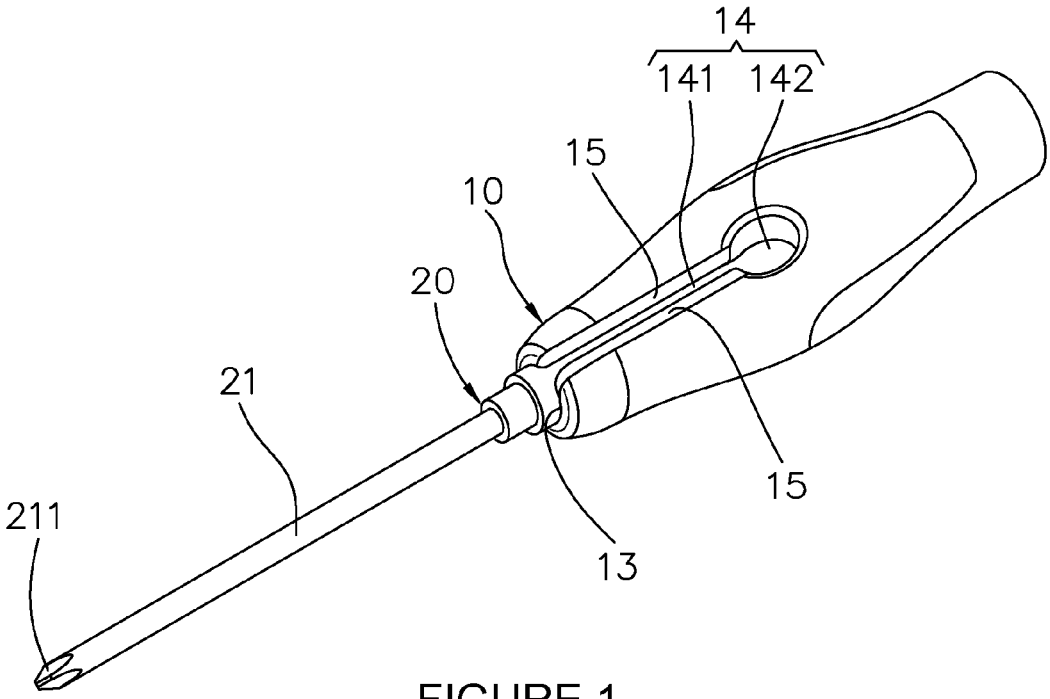
FIG. 1 is a schematic perspective view of a hand tool having a pressing spring of the present invention.
Figure 2:
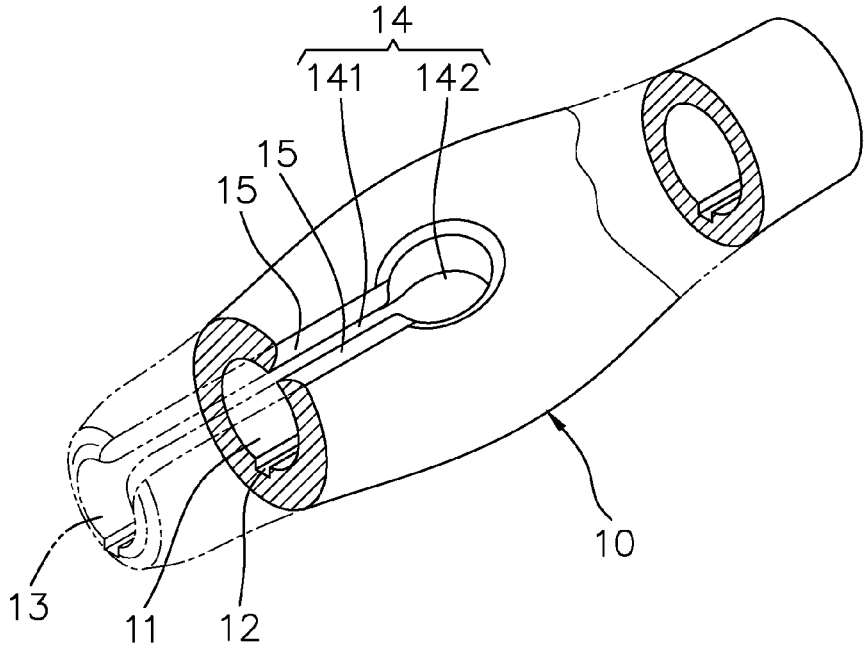
FIG. 2 is a schematic perspective view of a grip part of the present invention showing sectional views of portions thereof.
Figure 3:
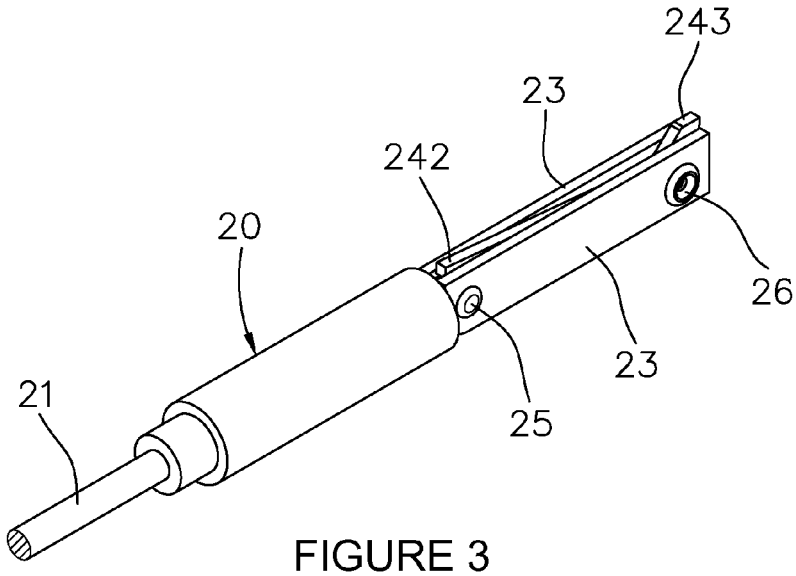
FIG. 3 is a schematic partial perspective view of a tool part of the present invention.
Figure 4:
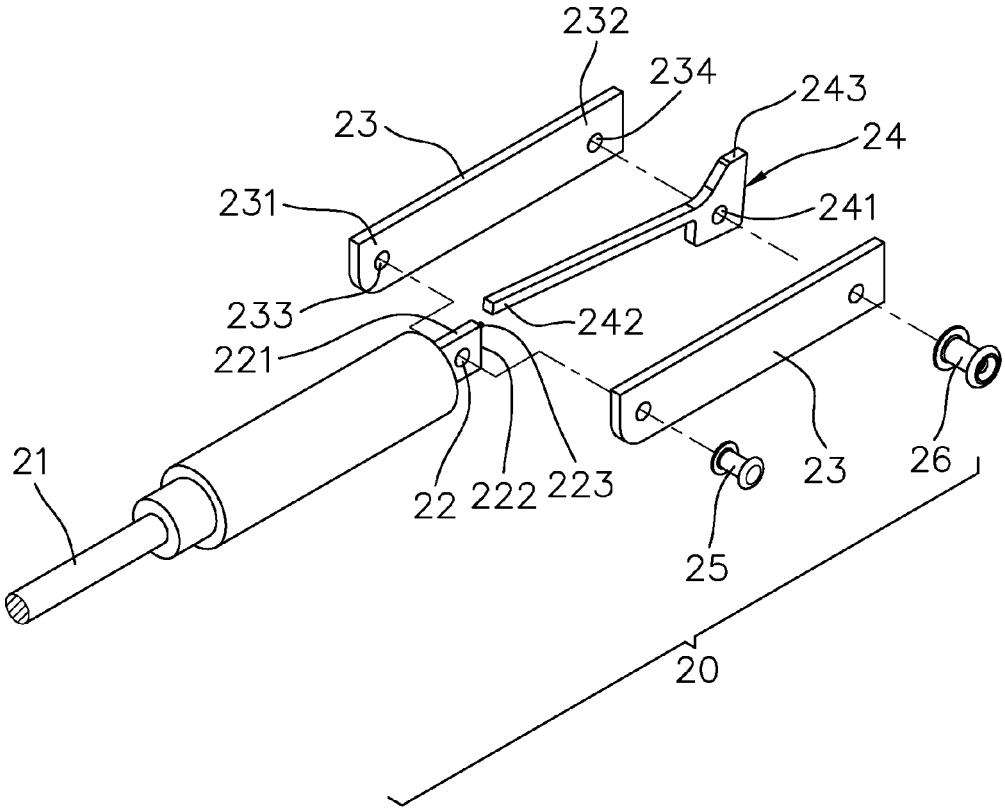
FIG. 4 is a schematic exploded partial perspective view of the tool part of the present invention.
Figure 5A:
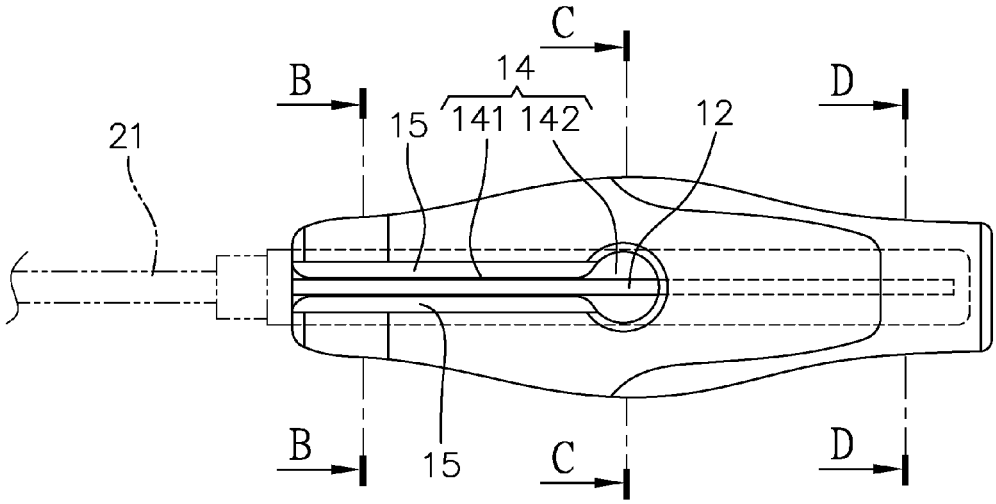
FIG. 5A is a schematic partial top view of the grip part of the present invention.
Figure 5B:
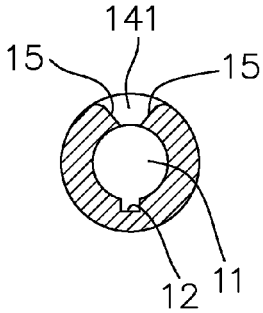
FIG. 5B is a schematic cross sectional view along a sectional line B-B of FIG. 5A.
Figure 5C:
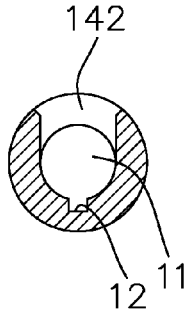
FIG. 5C is a schematic cross sectional view along a sectional line C-C of FIG. 5A.
Figure 5D:
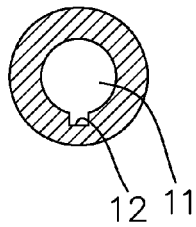
FIG. 5D is a schematic cross sectional view along a sectional line D-D of FIG. 5A.
Figure 5E:
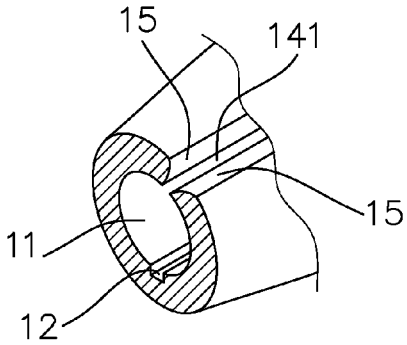
FIG. 5E is a schematic partial perspective view of the grip part of the present invention showing the cross sectional view along the sectional line B-B of FIG. 5A.
Figure 5F:
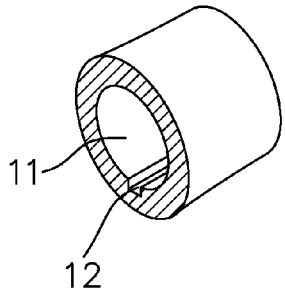
FIG. 5F is a schematic partial perspective view of the grip part of the present invention showing the cross sectional view along the sectional line D-D of FIG. 5A.

With reference to FIGS. 1 to 4, the present invention is related to a hand tool having a pressing spring. The hand tool comprises a grip part 10 and a tool part 20.

Regarding to the grip part 10, the grip part 10 comprises an interior passageway 11, a guide groove 12, a passageway opening 13, a wall opening 14 and a pair of flexible stopper parts 15. The interior passageway 11 comprises two ends. One end thereof is disposed as the passageway opening 13 and the other end thereof is defined as a closed end. The guide groove 12 is communicated with the interior passageway 11, and extends parallel to the interior passageway 11 along an axial direction of the interior passageway 11. The pair of flexible stopper parts 15 is deformable and restorable after deformation.

The tool part 20 is partially disposed in the interior passageway 11 of the grip part 10. The tool part 20 comprises a tool rod 21, a tool rod pivot head 22, a pair of external fixing pieces 23, a pressing spring 24, a pivot shaft 25 and a fixing element 26.

One end of the tool rod 21 comprises a work part 211, and the other end thereof is set as the tool rod pivot head 22.

The tool rod pivot head 22 comprises a first pressing surface 221, a second pressing surface 222 and a bump 223.

Each of the pair of the external fixing pieces 23 comprises a first end part 231 and a second end part 232. The first end part 231 of the each external fixing piece 23 comprises a first hole 233, and the second end part 232 of the each external fixing piece 23 comprises a second hole 234.

The pressing spring 24 comprises a fixing hole 241, a spring part 242, and a protruding guide part 243. The protruding guide part 243 is engaged and snapped in the guide groove 12.

The pivot shaft 25 is disposed to pass through the tool rod pivot head 22 and the first holes 233 of the pair of the external fixing pieces 23. Accordingly, the pair of the external fixing pieces 23 is capable of being pivotally connected to the tool rod pivot head 22.

The fixing element 26 is used to pass through the second holes 234 of the pair of the external fixing pieces 23 and the fixing hole 241 of the pressing spring 24 and is fixed therein so as to integrally fix the pair of the external fixing pieces 23 and the pressing spring 24 together.

Accordingly, the tool rod 21 and the pair of the external fixing pieces 23 are capable of being switched between a collinear relationship thereof and a vertical relationship thereof. When they are in the collinear relationship thereof, the pressing spring 24 presses on the first pressing surface 221 of the tool rod pivot head 22 to maintain the collinear relationship between the tool rod 21 and the pair of the external fixing pieces 23 without being loose. On the contrary, when they are in the vertical relationship thereof, the pressing spring 24 presses on the second pressing surface 222 of the tool rod pivot head 22 to maintain the vertical relationship between the tool rod 21 and the pair of the external fixing pieces 23 without being loose.

In more details, the grip part 10 is able to be chosen any material forcible to be deformable by an external force, such as rubber. In view of design, an inner diameter of the interior passageway 11 is substantially and roughly same with an outer diameter of the tool part 20, or is slightly smaller than the outer diameter of the tool part 20. In other words, in assembly, the protruding guide part 243 of the tool part 20 is firstly aligned with the guide groove 12, and then the tool part 20 is forced to fit in the interior passageway 11 in use of deformable characteristics of the composition material of the grip part 10.

Regarding to the detail structure of the grip part 10, please refer to FIGS. 5A to 5F.

As shown in FIGS. 5A to 5F, the wall opening 14 comprises a narrow segment 141 and an opening segment 142. The narrow segment 141 corresponds to the pair of the flexible stopper parts 15, and a width of the narrow segment 141 is less than the outer diameter of the tool rod 21 while a width of the opening segment 142 is substantially and roughly equal to the outer diameter of the tool rod 21. When a relationship between the tool rod 21 and the pair of the external fixing pieces 23 in process is switched from the collinear relationship thereof to the vertical relationship thereof, the tool rod 21 passes through the narrow segment 141 first by forcing the pair of the flexible stopper parts 15 to deform because the outer diameter of the tool rod 21 is greater than the width of the narrow segment 141. Finally, is the tool rod 21 passes through the narrow segment 141 to reach and be located in the opening segment 142.

Figure 6:
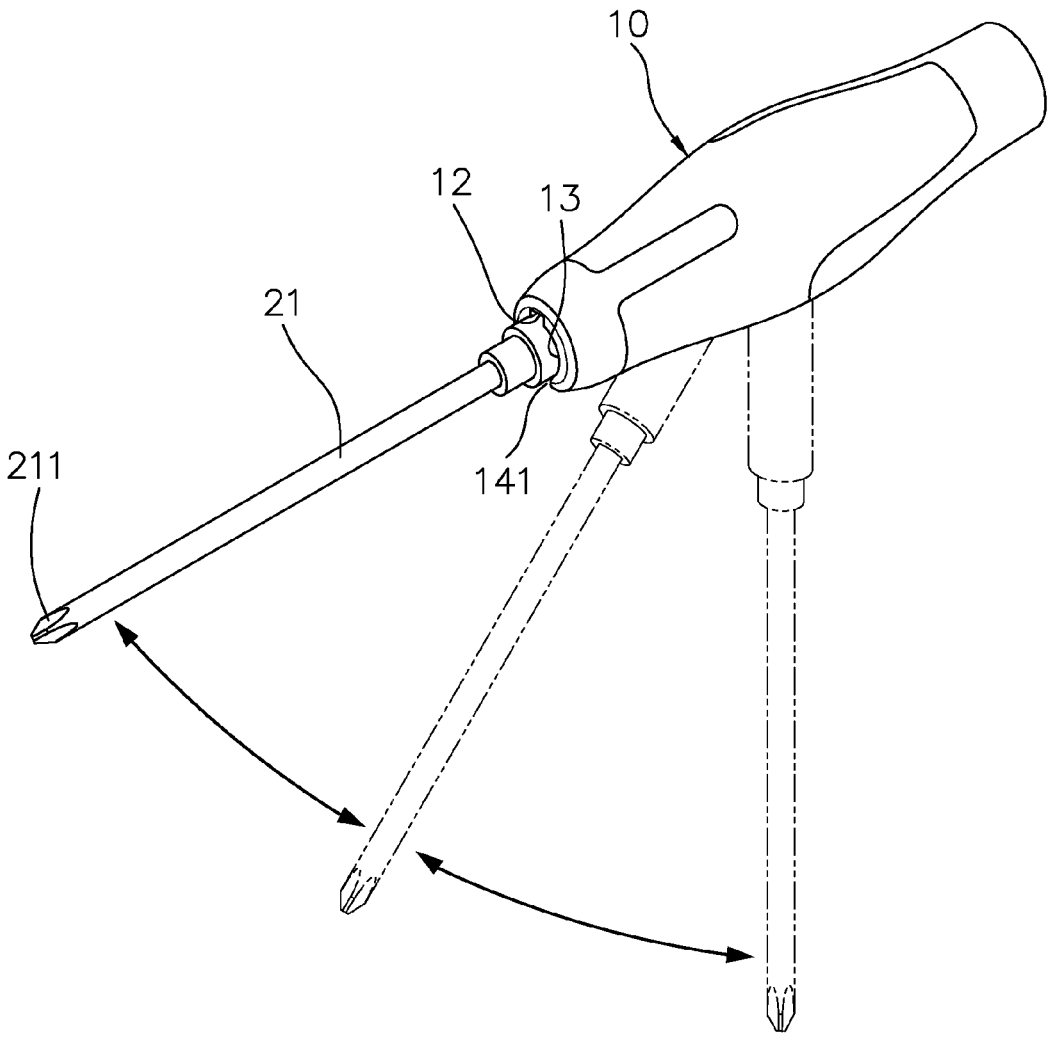
FIG. 6 is a schematic perspective view of the hand tool of the present invention showing a relationship of a switching process thereof.

As shown in FIG. 6, appearance change of the hand tool is presented during switch of the collinear relationship and the vertical relationship between the tool rod 21 and the pair of the external fixing pieces 23. Referring to FIG. 6, it is understandable that simply directly turning the tool rod 21 of the present invention is capable of switching the tool rod 21 to one of the collinear relationship and the vertical relationship Thereof according to different user needs (Based on an angle of view of FIG. 6, the wall opening 14 faces downward).

Figure 7A:
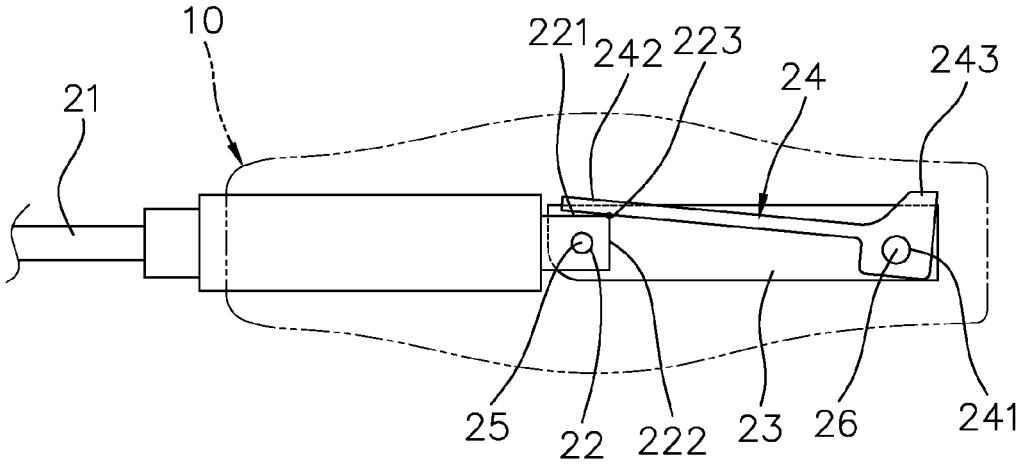
FIG. 7A is a schematic partial side view of the hand tool of the present invention showing details for the tool part in a first step of the switching process.

As shown in FIG. 7A, when the tool rod 21 and the pair of the external fixing pieces 23 are in the collinear relationship thereof, the pressing spring 24 is pressed on the first pressing surface 221 of the tool rod pivot head 22 to maintain the collinear relationship between the tool rod 21 and the pair of the external fixing pieces 23 without being loose.

Figure 7B:
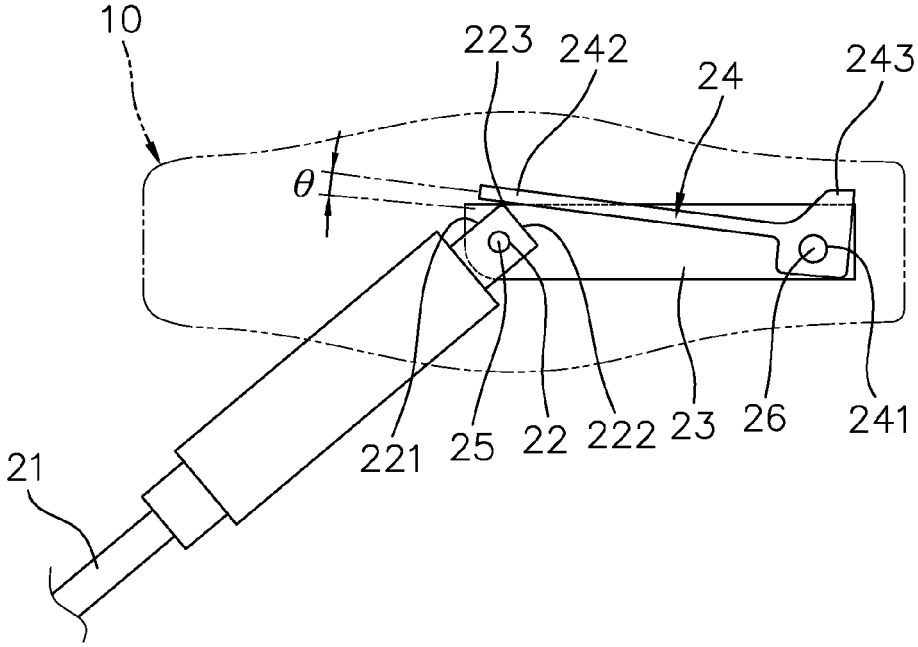
FIG. 7B is a schematic partial side view of the hand tool of the present invention showing details for the tool part in a second step of the switching process.

As shown in FIG. 7B, when the tool rod 21 and the pair of the external fixing pieces 23 is in process of switching from the collinear relationship to the vertical relationship thereof, the rotated tool rod 21 uses the bump 223 thereof to engage and push the spring part 242 of the pressing spring 24 being slightly deformed with a predetermined angle θ in comparison to its original location shown in FIG. 7A.

Figure 7C:
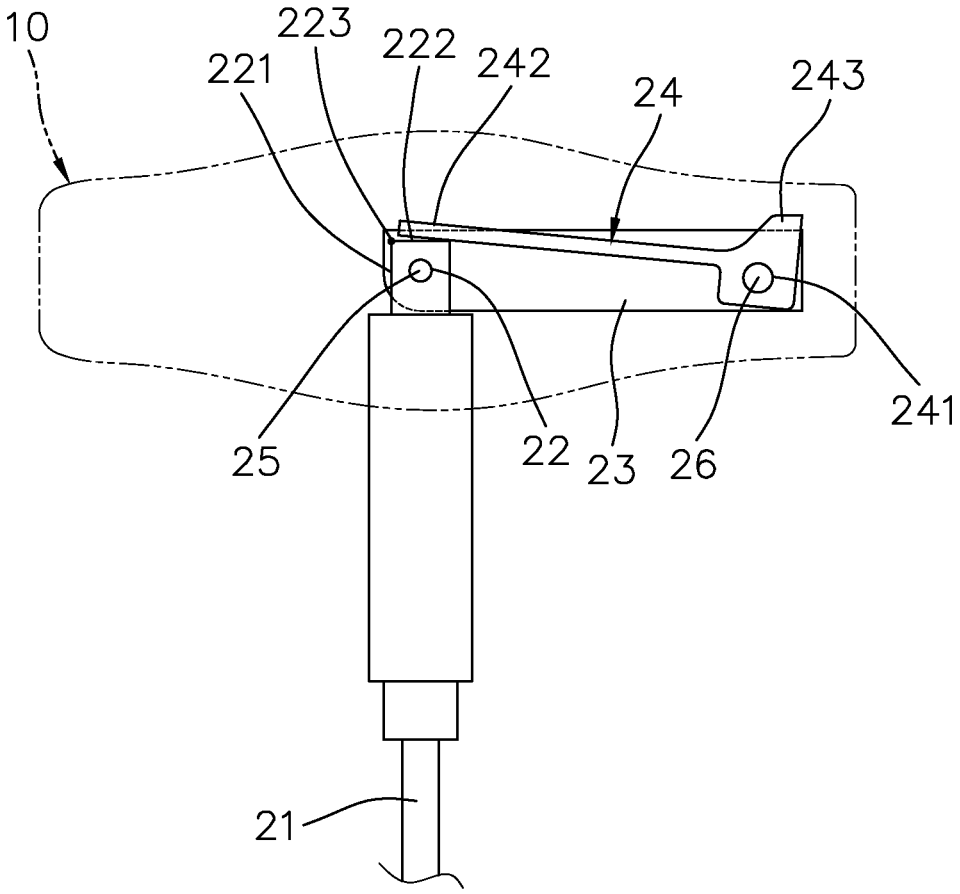
FIG. 7C is a schematic partial side view of the hand tool of the present invention showing details for the tool part in a third step of the switching process.

As shown in FIG. 7C, when the bump 223 slides and passes the spring part 242 to allow the tool rod 21 rotating toward the vertical relationship thereof with the pair of the external fixing pieces 23, the spring part 242 of the pressing spring 24 restores to its original state without being deformed and presses on the second pressing surface 222 of the tool rod pivot head 22 to maintain the vertical relationship between the tool rod 21 and the pair of the external fixing pieces 23 without being loose.

Of course, if the tool rod 21 and the external fixing piece 23 are desired to be switched from the vertical relationship to the collinear relationship thereof, the switch process sequence is reversely applied from FIG. 7C to FIG. 7A.

In design, the spring part 242 of the pressing spring 24 possesses an extremely strong pressing force. Therefore, whether the hand tool is used in the collinear relationship or the vertical relationship of the tool part 21, the spring part 242 is capable of applying a significantly strong pressing force to press the first pressing surface 221 or the second pressing surface 222 in order to allow firm and stable positioning of the tool rod 21 without being easy to be loose. Certainly, the pressing force of the spring part 242 becomes much stronger, applied forces required for rotation of the tool rod 21 is also relatively much larger.

In addition, because the spring part 242 of the pressing spring 24 of the present invention has an extremely strong pressing force, the hand tool, in operation, is not prone to be loose whether the hand tool is in the collinear relationship or the vertical relationship thereof. As a result, a greater torque force is capable to be applied on the hand tool for users in operation (For example, dismantling or fastening screws).

In summary, advantages and effects of the present invention can be summarized as follows:

1. The hand tool of the present invention can be switched directly. Traditional switchable hand tools are able to release their fixing status only when a switching button thereof is pressed in process of switching between a vertical relationship and a linear relationship thereof. Apparently, it is very operationally inconvenient. In the present invention, only the tool rod 21 is in need of being rotated to switch between the collinear relationship and the vertical relationship thereof, and its operation is quite simple and convenient.

2. Positioning of the hand tool of the present invention is firm and stable and is not easy to be loose. Traditional switchable hand tools use their switching buttons to realize switching and releasing of their fixing status. Such design is usually difficult to achieve strong fixing purposes, and therefore results in problems during use, such as slack positioning and easily loosing, and so on. On the contrary, the pressing spring 24 of the present invention has an extremely strong pressing force to make the tool rod 21 being tightly positioned and not easy to be loose so as to effectively avoid loose problem during operation.

The above are detailed descriptions of the present invention only based on the preferred embodiments. It is apparent to be understandable that a variety of modifications and changes may be easily made without departing from the inventive spirit and the scope of claims of the present invention.

From detailed descriptions shown above, it is apparent to those skilled in the art to understand the present invention and practice the present invention in order to achieve the aforementioned inventive purposes. The present invention is qualified by law to propose a new patent application.

What is claimed is:

1. A hand tool having a pressing spring, comprising:

a grip part, comprising an interior passageway, a guide groove, a passageway opening, a wall opening and a pair of flexible stopper parts, the interior passageway comprising two ends, one end thereof defined as the passageway opening and the other end thereof defined as a closed end, the guide groove communicating with the interior passageway and extending parallel to the interior passageway along an axial direction of the interior passageway, and the pair of flexible stopper parts being deformable and restorable after deformation;

a tool part partially disposed in the interior passageway of the grip part, and comprising a tool rod, a tool rod pivot head, a pair of external fixing pieces, a pressing spring, a pivot shaft and a fixing element;

one end of the tool rod comprising a work part, and the other end thereof set as the tool rod pivot head;

the tool rod pivot head comprising a first pressing surface, a second pressing surface and a bump;

each of the pair of external fixing pieces comprising a first end part and a second end part, the first end part of the each external fixing piece comprising a first hole, and the second end part of the each external fixing piece comprising a second hole;

the pressing spring comprising a fixing hole, a spring part and a protruding guide part, the protruding guide part engaged and snapped in the guide groove;

the pivot shaft disposed to pass through the tool rod pivot head and the first holes of the pair of external fixing pieces in order that the pair of external fixing pieces are pivotally connected to the tool rod pivot head; and the fixing element used to pass through the second holes of the pair of external fixing pieces and the fixing hole of the pressing spring, and fixed therein so as to integrally fix the pair of external fixing pieces and the pressing spring together;

wherein the tool rod and the pair of external fixing pieces are switchable between a collinear relationship thereof and a vertical relationship thereof, when in the collinear relationship thereof, the pressing spring presses on the first pressing surface of the tool rod pivot head to maintain the collinear relationship between the tool rod and the pair of external fixing pieces without being loose, when in the vertical relationship thereof, the pressing spring presses on the second pressing surface of the tool rod pivot head to maintain the vertical relationship between the tool rod and the pair of external fixing pieces without being loose.

2. The hand tool having a pressing spring as claimed in claim 1, wherein the wall opening comprises a narrow segment and an opening segment, the narrow segment corresponds to the pair of flexible stopper parts, and a width of the narrow segment is less than an outer diameter of the tool rod, a width of the opening segment is substantially equal to the outer diameter of the tool rod.

* * * * *